US006427578B1

(12) United States Patent
Kaneko

(10) Patent No.: US 6,427,578 B1
(45) Date of Patent: Aug. 6, 2002

(54) RODLESS CYLINDER

(75) Inventor: Junya Kaneko, Abiko (JP)

(73) Assignee: SMC Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/686,984

(22) Filed: Oct. 17, 2000

(30) Foreign Application Priority Data

Oct. 18, 1999 (JP) ..... 11-295812

(51) Int. Cl.[7] ..... F01B 29/00
(52) U.S. Cl. ..... 92/88; 92/128
(58) Field of Search ..... 92/59, 88, 128, 92/164, 169.1

(56) References Cited

U.S. PATENT DOCUMENTS 6,148,714 A * 11/2000 Abe et al. ..... 92/88

* cited by examiner

*Primary Examiner*—Edward K. Look
*Assistant Examiner*—Michael Leslie
(74) *Attorney, Agent, or Firm*—Paul A. Guss

(57) ABSTRACT

A rodless cylinder comprises a cylinder tube having, at its inside, a piston which is movable back and forth in a longitudinal direction; fluid bypass passages defined at the inside of the cylinder tube to extend in the longitudinal direction; and a pair of head covers installed to ends of the cylinder tube. The head cover has a side surface provided with at least one fluid pressure inlet/outlet port, in and an end surface provided with at least two fluid pressure inlet/outlet port. Further, the head cover is provided with at least four or more fluid pressure inlet/outlet ports.

20 Claims, 8 Drawing Sheets

RODLESS CYLINDER

BACKGROUND OF THE INVENTION

1. Field of the Invention

The present invention especially relates to a rodless cylinder in which head covers installed to ends of a cylinder tube are mutually exchangeable and commonly usable.

2. Description of the Related Art

In recent years, the rodless cylinder is adopted in various cases as an apparatus for transporting a workpiece in a factory or the like. The rodless cylinder makes it possible to shorten the entire length with respect to the displacement length as compared with a cylinder which has a rod. Therefore, the rodless cylinder occupies a small area, and it is conveniently handled, making it possible to perform, for example, highly accurate positioning operation.

As shown in FIG. 8, the rodless cylinder 1 concerning the conventional technique includes a cylinder tube 2, a slide table 3, and a pair of head covers 4, 5. The rodless cylinder 1 has two lines of passages 8, 9 for allowing the compressed fluid to flow therethrough. The respective head covers 4, 5 are provided with fluid pressure inlet/outlet ports 6*a* to 6*f*, 7*a* to 7*f* which serve as introducing ports for the compressed fluid.

A passage 8 for allowing the compressed fluid to flow communicates with the fluid pressure inlet/outlet ports 6*a* to 6*f*. Another passage 9 communicates with the fluid pressure inlet/outlet ports 7*a* to 7*f*. Further, the passages 8, 9 are conducted to the inside of the space in which an unillustrated piston, which is arranged at the inside of the cylinder tube 2, makes reciprocating movement. Any one of the fluid pressure inlet/outlet ports 6*a* to 6*f* and any one of the fluid pressure inlet/outlet ports 7*a* to 7*f* are provided on first principal surfaces of the respective head covers 4, 5.

In the case of the rodless cylinder 1, a pair of the fluid pressure inlet/outlet ports 6*a*, 7*a* are selected as ports for introducing/discharging the compressed fluid. Further, the other fluid pressure inlet/outlet ports 6*b* to 6*f*, 7*b* to 7*f*, which are not used, are closed by plug members.

The slide table 3 is moved linearly in the direction of the arrow A shown in FIG. 8 in accordance with the action of the supply of the compressed fluid supplied via the fluid pressure inlet/outlet port 6*a*. When the compressed fluid is supplied via the fluid pressure inlet/outlet port 7*a*, the slide table 3 is moved linearly in the direction of the arrow B shown in FIG. 8.

However, in the case of the rodless cylinder 1 concerning the conventional technique, as described above, each one of any one of the fluid pressure inlet/outlet ports 6*a* to 6*f* communicating with the passage 8 and any one of the fluid pressure inlet/outlet ports 7*a* to 7*f* communicating with the passage 9 is provided on each of the first principal surfaces of the respective head covers 4, 5. Therefore, the compressed fluid passages, which are formed at the inside of the head cover 4 and the head cover 5 respectively, are asymmetric with respect to the short side direction of the cylinder tube 2. For this reason, the head cover 4 and the head cover 5 are not mutually exchangeable, and they cannot be commonly used.

Therefore, for example, when the head covers are formed by using an injection molding machine, it is necessary to use two types of molds. Further, it is necessary to use jigs corresponding to the respective molds. Therefore, a problem is pointed out that the operation for adjusting the jig is complicated, and the production cost is expensive for the rodless cylinder as a whole.

Further, it is necessary that the two lines of the passages 8, 9, which are disposed at the inside of the cylinder tube 2, are defined in a separate manner respectively. An inconvenience arises such that the size of the rodless cylinder 1 in the height direction is large, and it is impossible to respond to the demand for realization of a small size. Further, the size of the rodless cylinder 1 is increased, and the installation space is enlarged.

SUMMARY OF THE INVENTION

A general object of the present invention is to provide rodless cylinder which makes it possible to miniaturize the rodless cylinder and reduce the installation space.

A principal object of the present invention is to provide a rodless cylinder which makes it possible to mold head covers of the rodless cylinder with a single mold.

Another object of the present invention is to provide a rodless cylinder which makes it possible to reduce the production cost of the rodless cylinder as a whole and which makes it possible to achieve a small size and a reduced installation space.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
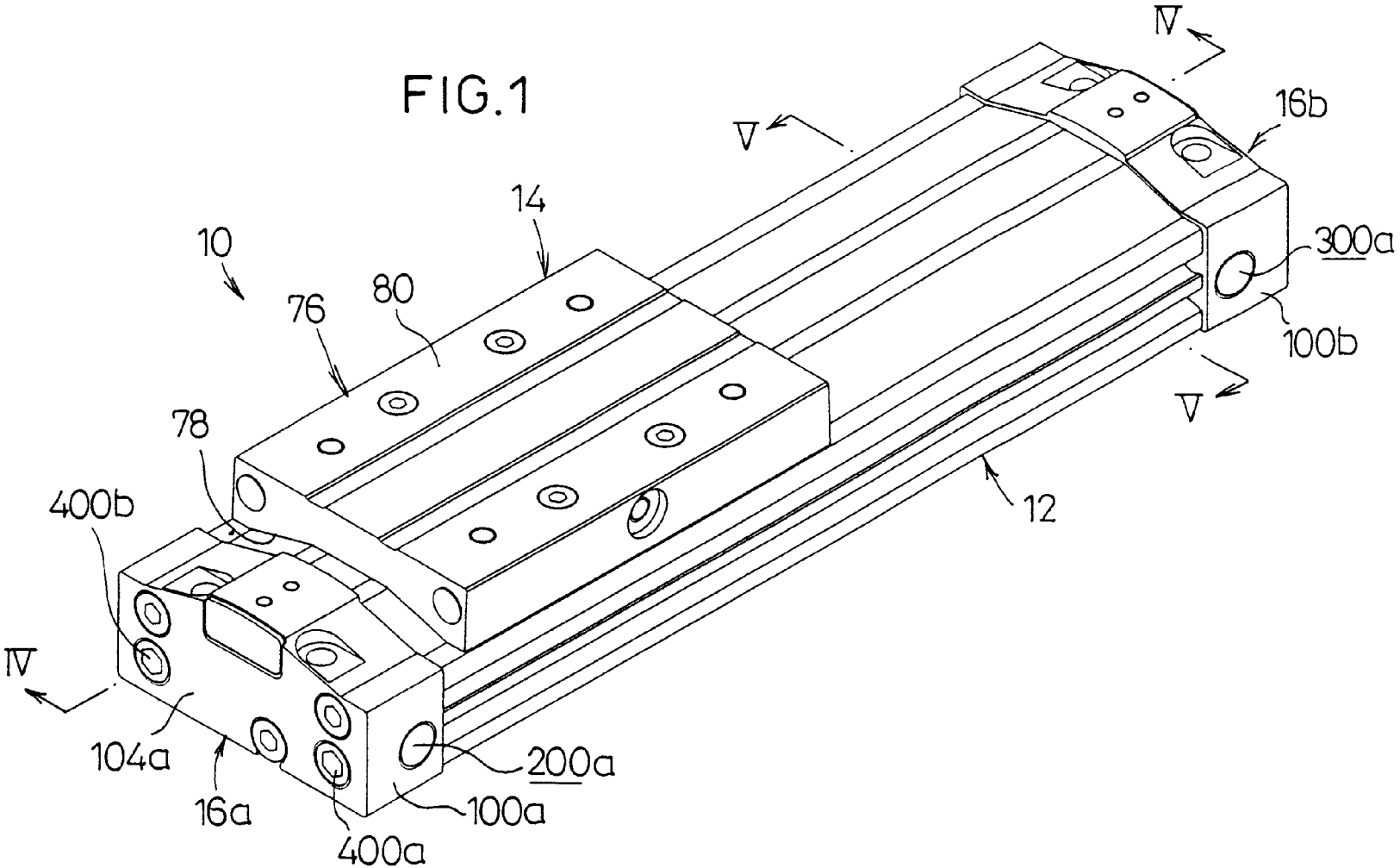
FIG. 1 shows a perspective view illustrating a rodless cylinder according to an embodiment of the present invention.

As shown in FIG. 1, a rodless cylinder 10 according to an embodiment of the present invention basically comprises a cylinder tube 12, a slide table 14 which is arranged on an upper surface portion of the cylinder tube 12 and which is capable of making sliding contact in a longitudinal direction of the cylinder tube 12, and a pair of head covers 16*a*, 16*b* which are installed to both ends of the cylinder tube 12.

Figure 2:
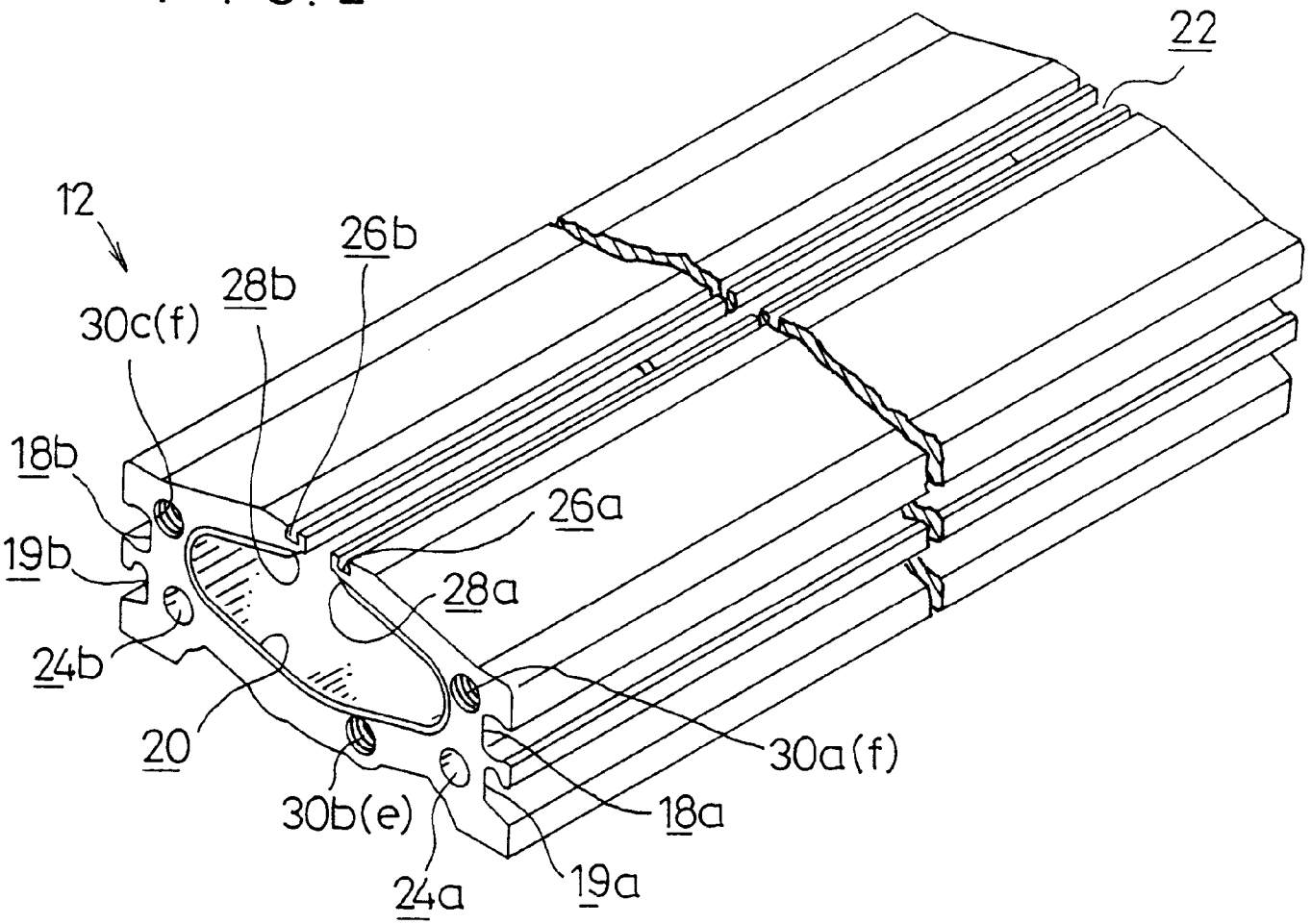
FIG. 2 shows a perspective view illustrating a cylinder tube of the embodiment of the present invention.
Figure 3:
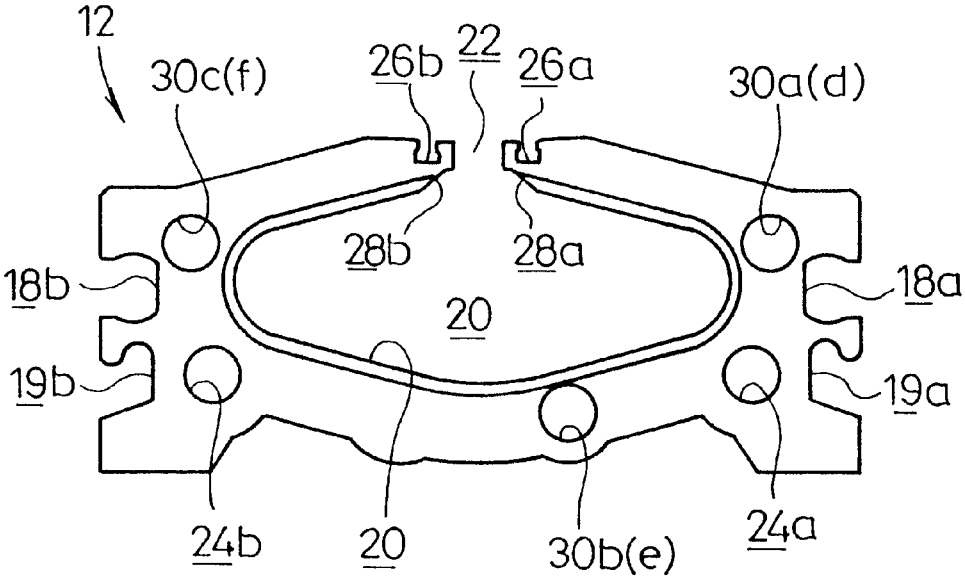
FIG. 3 shows a side view illustrating the cylinder tube of the embodiment of the present invention.

The cylinder tube 12 is molded, for example, by means of extrusion processing with a metal material such as aluminum and aluminum alloy. As shown in FIGS. 2 and 3, the cylinder tube 12 has upper surface portions which are gently inclined to the both ends over the upper surface, with its lower surface portion which is formed to have a rectangular gutter-shaped configuration.

Sensor-attaching long grooves 18*a,* 18*b* for installing a magnetic sensor (not shown) to detect the position of a piston 50 described later on, and intermediate fixing fixture-attaching long grooves 19*a,* 19*b* for attaching an intermediate fixing fixture (not shown) are defined on both side surfaces of the cylinder tube 12 so that they extend in the longitudinal direction of the cylinder tube 12 (see FIGS. 2 and 3).

As shown in FIGS. 2 and 3, a bore 20, which extends in the longitudinal direction of the cylinder tube 12, is formed at the inside of the cylinder tube 12. The bore 20 has a substantially rhombic cross section, with respective angular portions which are formed to have gentle circular arc-shaped configurations.

A slit 22, which extends in the longitudinal direction of the cylinder tube 12, is provided at an upper surface portion of the cylinder tube 12. The bore 20 communicates with the outside via the slit 22 (see FIG. 3). Fluid bypass passages 24*a,* 24*b* for concentrated pipe arrangement, which extend along the bore 20, are defined at portions in the vicinity of the lower side on both sides of the bore 20 at the inside of the cylinder tube 12 (see FIG. 3). The fluid bypass passages 24*a,* 24*b* are formed such that the height dimension is identical for each of them from the bottom surface of the cylinder tube 12.

On the other hand, as shown in FIGS. 2 and 3, belt-installing grooves 26*a,* 26*b* for installing an upper belt 62 described later on are defined along the slit 22 on both sides of the slit 22 at the upper surface portion of the cylinder tube 12. Tapered surfaces 28*a,* 28*b,* which have predetermined angles to be expanded toward the bore 20, are provided at boundary portions between the bore 20 and the slit 22 (see FIG. 3).

Screw holes 30*a* to 30*f* for installing the pair of head covers 16*a,* 16*b* are provided at three positions at the both ends of the cylinder tube 12 (see FIGS. 2 and 3).

Figure 4:
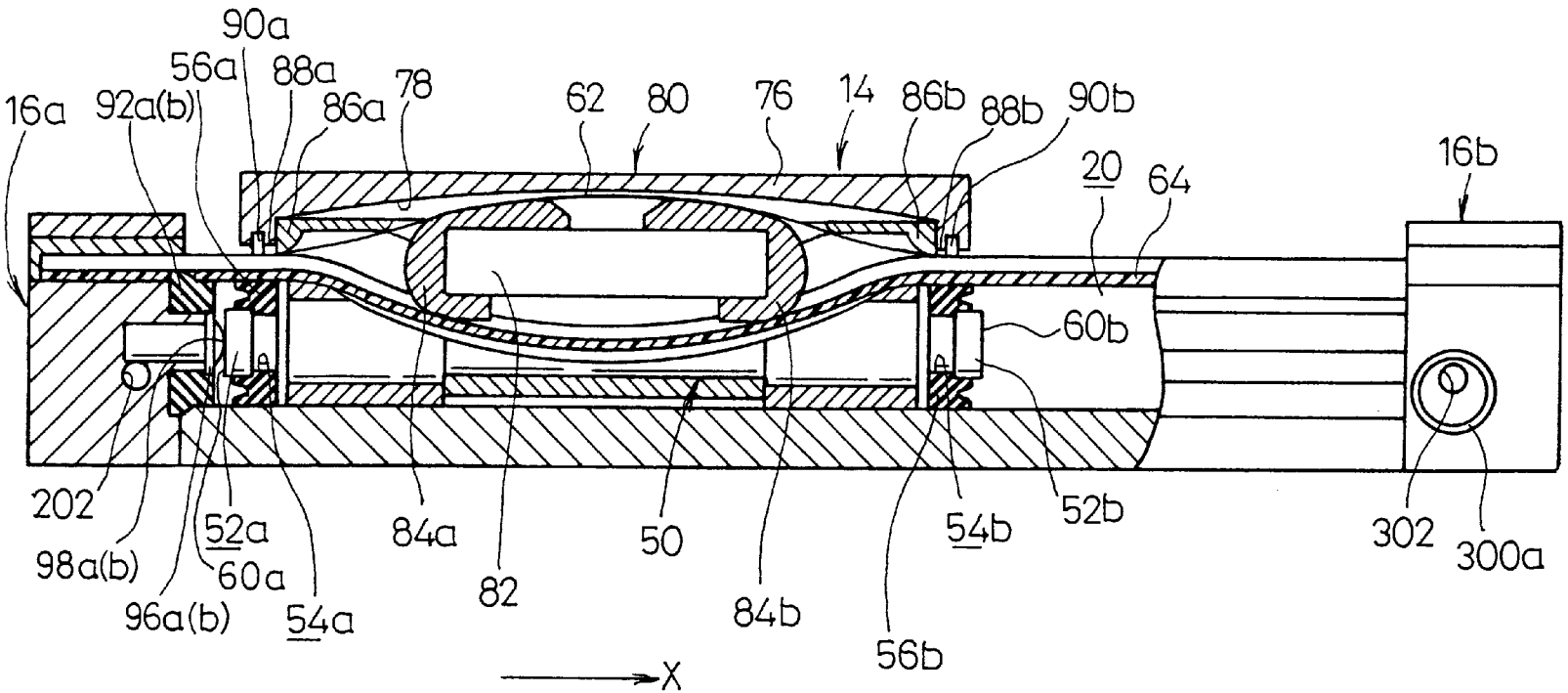
FIG. 4 shows a sectional view taken along a line IV—IV illustrating the rodless cylinder shown in FIG. 1.
Figure 5:
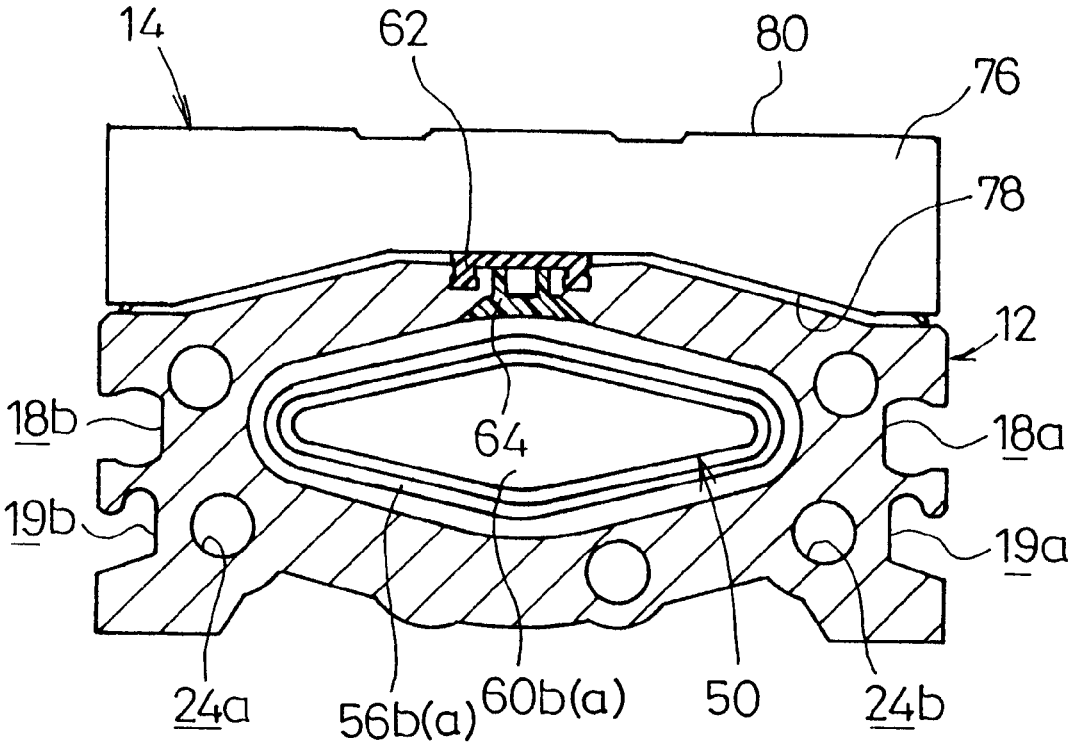
FIG. 5 shows a sectional view taken along a line V—V illustrating the rodless cylinder shown in FIG. 1.

As shown in FIGS. 4 and 5, a piston 50, which has a cross-sectional configuration corresponding to the bore 20, is accommodated at the inside of the bore 20 of the cylinder tube 12 so that the piston 50 is movable back and forth along the bore 20. The piston 50 has, at both ends in the longitudinal direction, projections 52*a,* 52*b* which are formed with circumscribing grooves 54*a,* 54*b*. Seal members 56*a,* 56*b* made of rubber are fitted to the circumscribing grooves 54*a,* 54*b* (see FIG. 4). Forward end surfaces of the projections 52*a,* 52*b* function as pressure-receiving surfaces 60*a,* 60*b* for the compressed fluid introduced into the inside of the bore 20 as described later on.

As shown in FIG. 5, the outer circumferential configuration of each of the seal members 56*a,* 56*b* is formed to have a substantially rhombic configuration corresponding to the cross-sectional configuration of the bore 20, in which each of angular portions is formed to have a gentle circular arc-shaped configuration.

Figure 6:
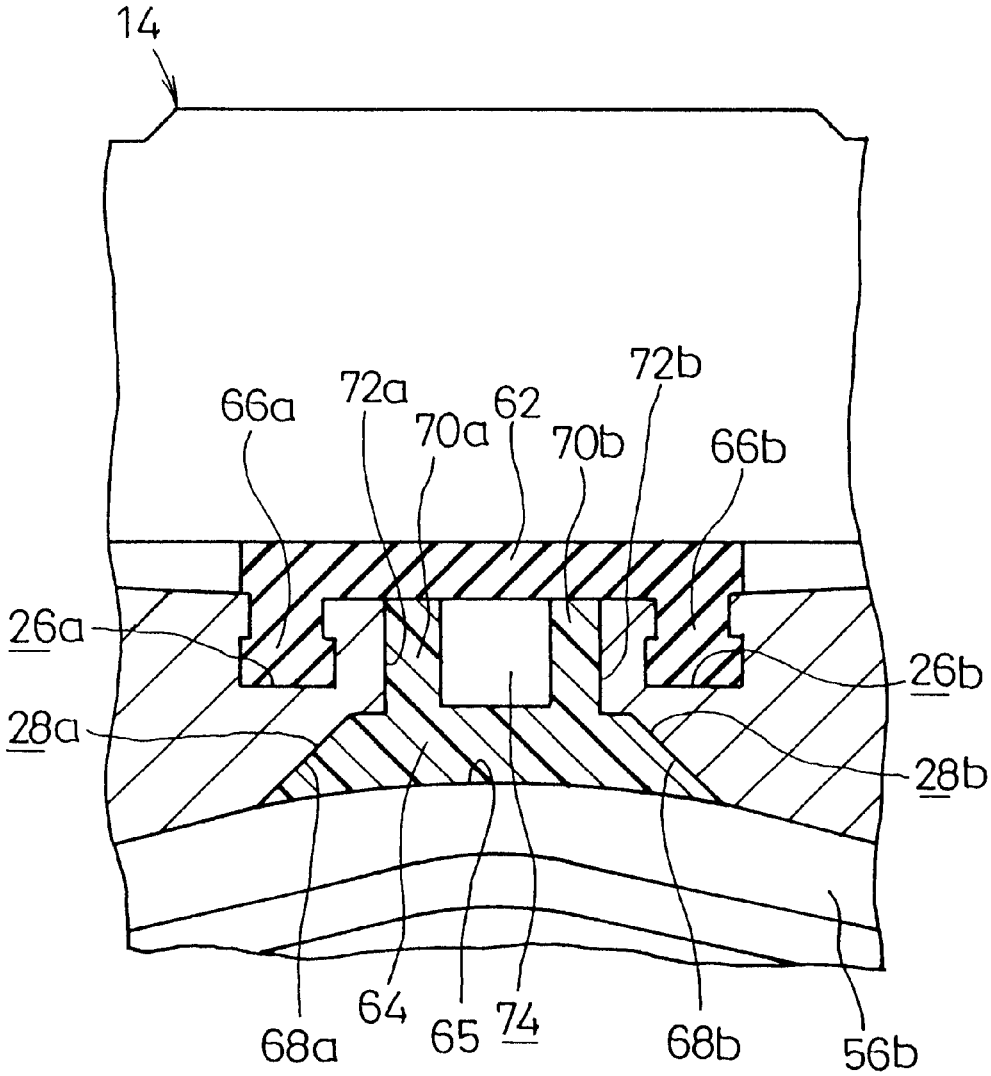
FIG. 6 shows a magnified sectional view illustrating portions disposed in the vicinity of a slit of the rodless cylinder according to the embodiment of the present invention.

As shown in FIGS. 4 to 6, an upper belt 62 and a lower belt 64 are installed to the slit 22 of the cylinder tube 12 so that the slit 22 is closed in the upper and lower directions.

As shown in FIG. 6, the upper belt 62 is provided with legs 66*a,* 66*b*. The upper belt 62 is installed to the cylinder tube 12 by fitting the legs 66*a,* 66*b* to the belt-installing grooves 26*a,* 26*b* of the cylinder tube 12. The upper belt 62 is made of a rubber material or a resin material. Alternatively, the upper belt 62 may be constructed in a separate manner with a flat plate-shaped plate member made of stainless steel and legs composed of a magnetic material so that the flat plate-shaped plate member is attracted by the legs.

As shown in FIG. 6, the lower belt 64 has, at its both end upper surface portions, tapered surfaces 68*a,* 68*b* which are formed corresponding to the tapered surfaces 28*a,* 28*b* of the cylinder tube 12. Engaging tabs 70*a,* 70*b* extend from the tapered surfaces 68*a,* 68*b* upwardly in the vertical direction while being separated from each other by a predetermined spacing distance. A substantially recess-shaped groove 74 is defined between the engaging tabs 70*a,* 70*b*. The groove 74 serves as a passage in which belt separators 84*a,* 84*b* are moved as described later on. As for the material of the lower belt 64, it is preferable that the lower belt 64 is composed of a flexible synthetic resin member.

The tapered surfaces 68*a,* 68*b* of the lower belt 64 are engaged with the tapered surfaces 28*a,* 28*b* which are provided on the cylinder tube 12. Further, the engaging tabs 70*a,* 70*b* are engaged with inner surfaces 72*a,* 72*b* which define the slit 22 (see FIG. 6). Accordingly, the lower belt 64 is installed to the cylinder tube 12. The lower surface portion 65 of the lower belt 64 is formed to have a circular arc-shaped configuration corresponding to the gentle circular arc-shaped configuration of the upper end portion (upper angular portion) of each of the seal members 56*a,* 56*b*. As shown in FIG. 4, both end portions of the upper belt 62 and the lower belt 64 are secured to the head covers 16*a,* 16*b* (however, only the left end is illustrated in FIG. 4).

As shown in FIGS. 1 and 5, the slide table 14 includes a placing surface 80 for placing a workpiece, and a relatively thick plate member 76 with its lower surface portion 78 which is curved toward the placing surface 80. Both end portions of the plate member 76 in the short side direction are formed to be substantially flushed with the ends of the cylinder tube 12. As shown in FIG. 4, a piston yoke 82, which is coupled to the piston 50 accommodated at the inside of the bore 20, is secured to the lower surface portion 78 of the slide table 14. Belt separators 84*a,* 84*b,* which are directed in the longitudinal direction of the bore 20, are attached to both ends of the piston yoke 82. The belt separators 84*a,* 84*b* are allowed to intervene between the upper belt 62 and the lower belt 64 which are installed to the slit 22 of the cylinder tube 12, in order that the upper belt 62 and the lower belt 64 are separated from each other in the vertical direction with respect to the cylinder tube 12.

Therefore, as described later on, the piston 50 is moved at the inside of the bore 20 in accordance with the action of the compressed fluid introduced into the inside of the bore 20. Accordingly, the slide table 14 is also moved on the upper surface portion of the cylinder tube 12 while being interlocked with the piston 50. During this process, the belt separators 84*a,* 84*b* pass through the space between the upper belt 62 and the lower belt 64 to separate the upper belt 62 and the lower belt 64 in the vertical direction with respect to the cylinder tube 12 as described above.

The upper belt 62, which is separated in the upward direction with respect to the cylinder tube 12, is allowed to pass through the space formed between the belt separator 84*a,* 84*b* and the slide table 14. The lower belt 64 is allowed to pass through the space formed between the belt separator 84*a,* 84*b* and the piston 50.

When the piston 50 is moved at the inside of the bore 20, the load is applied to the slide table 14 from the workpiece which is placed on the placing surface 80. The load is absorbed by an unillustrated guide mechanism.

Holding members 86*a,* 86*b* for pressing the upper belt 62 toward the cylinder tube 12 are provided at both ends in the longitudinal direction at the inside of the slide table 14 (see FIG. 4). That is, the holding members 86*a,* 86*b* function to install the upper belt 62 and the lower belt 64 to the slit 22 again, the upper belt 62 and the lower belt 64 having been separated from the slit 22 by the aid of the belt separators 84*a,* 84*b.*

As shown in FIG. 4, scrapers 90*a,* 90*b,* which make sliding contact with the upper belt 62, are provided on bottom surfaces 88*a,* 88*b* at the both ends in the longitudinal direction of the slide table 14. The dust or the like is excluded from invasion into the space between the slide table 14 and the upper belt 62 by the aid of the scrapers 90*a,* 90*b.*

As shown in FIG. 4, the pair of head covers 16*a,* 16*b* are installed to the both ends of the cylinder tube 12 by the aid of gaskets 92*a,* 92*b* which are made of, for example, a rubber material in order to close the cylinder tube 12. Accordingly, the air-tight state is maintained between the respective head covers 16*a,* 16*b* and the cylinder tube 12 (only the side of the head cover 16*a* is illustrated in FIG. 4).

Projections 98*a,* 98*b,* which have substantially semi-spherical forward ends 96*a,* 96*b,* are provided at portions of the gaskets 92*a,* 92*b* facing to the bore 20.

The projections 98*a,* 98*b* are capable of making abutment against the ends (pressure-receiving surfaces 60*a,* 60*b* ) of the piston 50. That is, when the piston 50 is moved back and force, and it arrives at the end of the bore 20 to collide with the head cover 16*a,* 16*b,* then the projection 98*a,* 98*b* functions to mitigate the shock caused by the collision.

Explanation will now be made with reference to FIG. 7 for two lines of compressed fluid passages R, L provided for the rodless cylinder 10 according to the embodiment of the invention.

Figure 7:
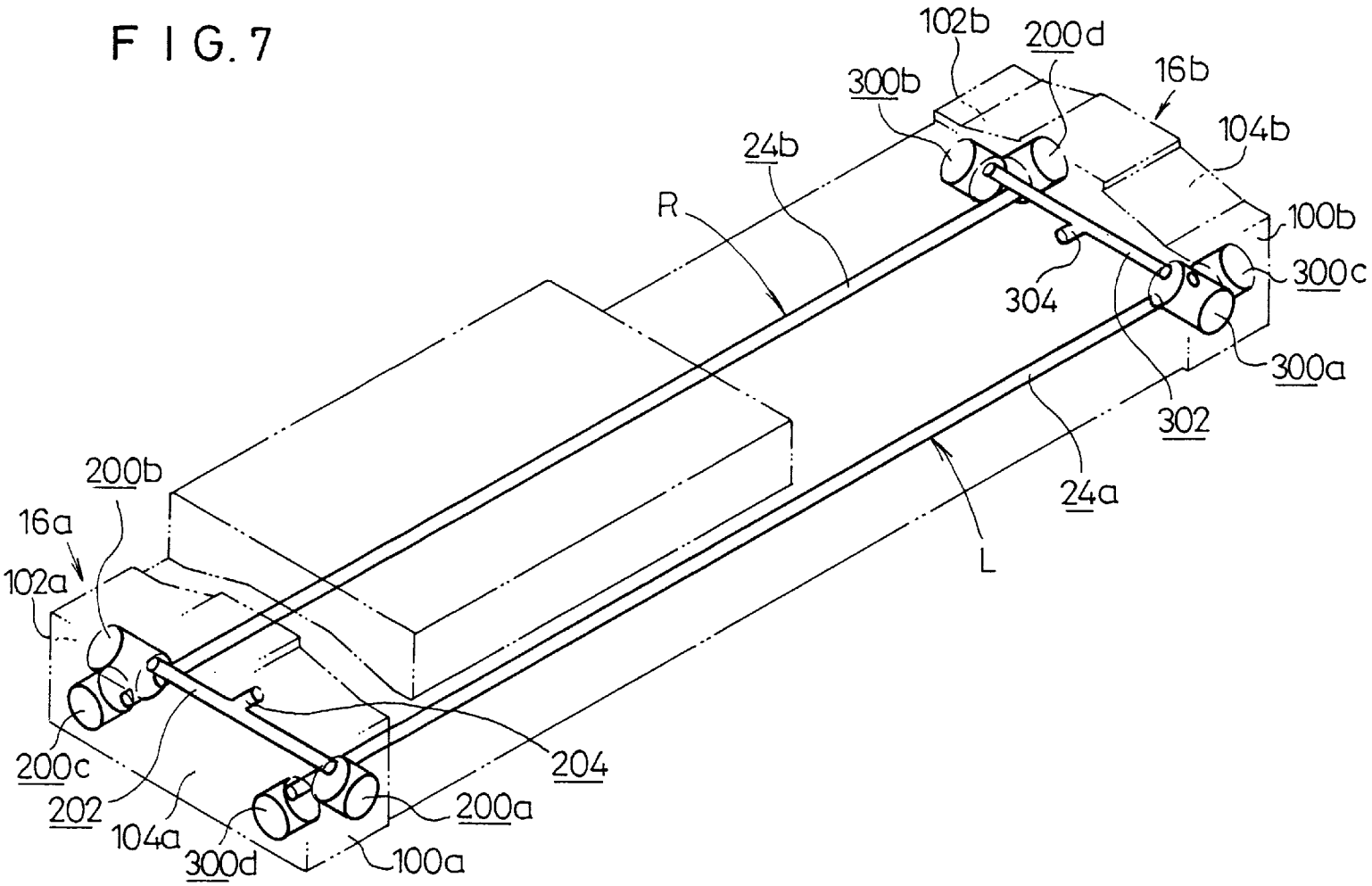
FIG. 7 shows, with partial omission, a perspective view illustrating compressed fluid passages and fluid pressure inlet/outlet ports formed in the rodless cylinder according to the embodiment of the present invention.

As shown in FIG. 7, the compressed fluid passage R includes fluid pressure inlet/outlet ports 200*a,* 200*b* which are formed on respective side surfaces 100*a,* 102*a* of the head cover 16*a* respectively, a fluid pressure inlet/outlet port 200*c* which is formed on the end surface 104*a* of the head cover 16*a,* a fluid pressure inlet/outlet port 200*d* which is formed on the end surface 104*b* of the head cover 16*b,* and the fluid bypass passage 24*b.*

Figure 8:
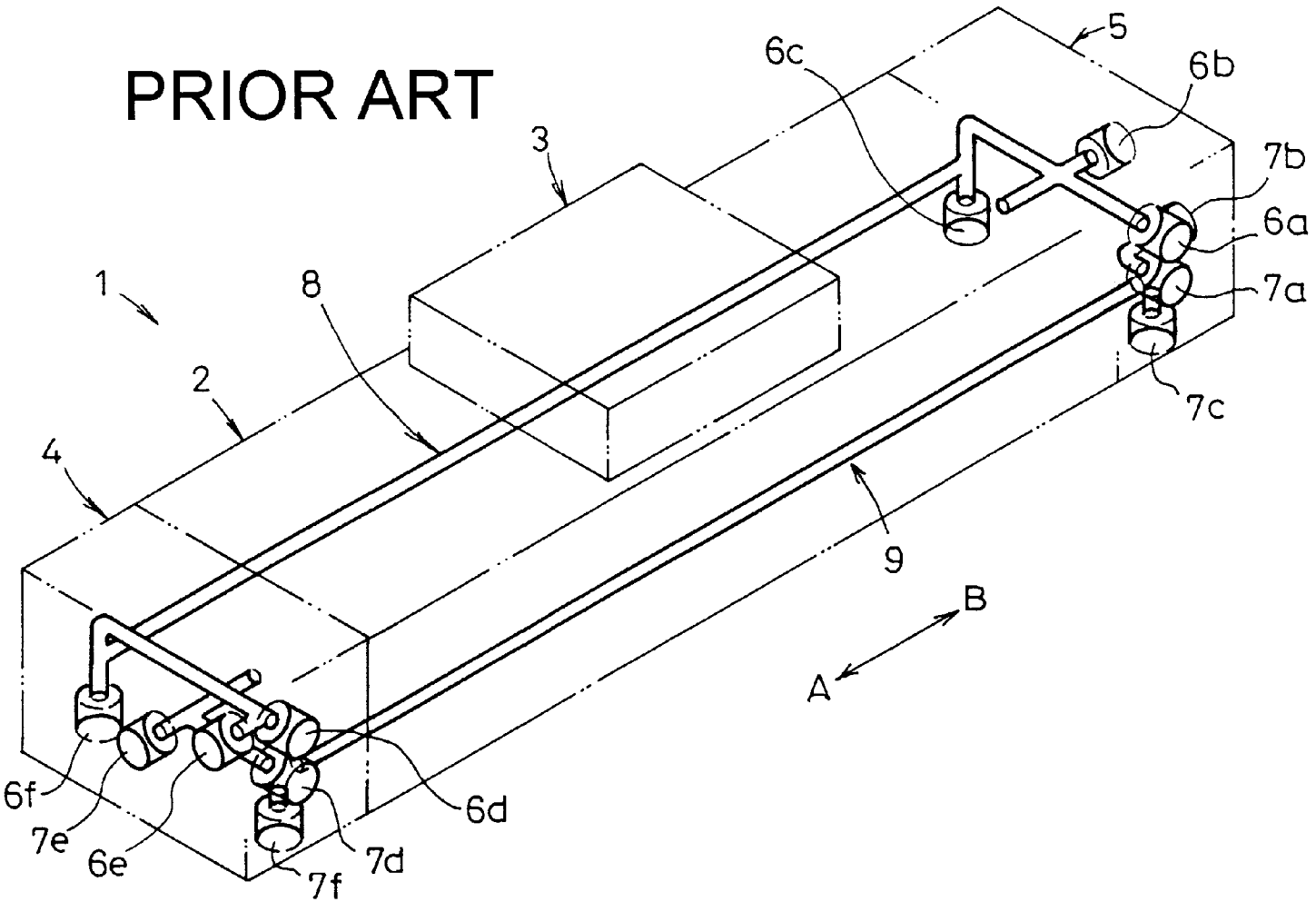
FIG. 8 PRIOR ART
FIG. 8 shows, with partial omission, a perspective view illustrating compressed fluid passages and fluid pressure inlet/outlet ports formed in a conventional rodless cylinder.

Only the single fluid pressure inlet/outlet port 200*a,* 200*b* is formed on each of the side surfaces 100*a,* 102*a*. Each of the fluid pressure inlet/outlet ports 200*c*, 200*d,* which is formed on each of the end surfaces 104*a,* 104*b,* is located at a lower portion of the end surface 104*a,* 104*b,* i.e., at a portion in the vicinity of the bottom of the head cover 16*a,* 16*b.* Further, the single fluid pressure inlet/outlet ports 200*a,* 200*b,* which are not overlapped with each other in the height direction, are provided on the respective side surfaces 100*a,* 102*a*. Accordingly, it is possible to suppress the dimension of the head cover 16*a,* 16*b* in the height direction as compared with the head cover 4, 5 concerning the conventional technique shown in FIG. 8. Of course, the positional relationship between the fluid pressure inlet/outlet port 200*a,* 200*b* and the fluid pressure inlet/outlet port 200*c* may be upside down in the head cover 16*a*. That is, the fluid pressure inlet/outlet port 200*a,* 200*b* may be located at a portion in the vicinity of the bottom of the head cover 16*a* as compared with the fluid pressure inlet/outlet port 200*c.*

The fluid pressure inlet/outlet ports 200*a* to 200*c* communicate with the fluid bypass passage 24*b* in the cylinder tube 12 via a communication passage 202 at the inside of the head cover 16*a*. The fluid bypass passage 24*b* communicates with the fluid pressure inlet/outlet port 200*d* at the inside of the head cover 16*b.* A conducting passage 204, which is branched from the communication passage 202, is disposed in parallel to the fluid bypass passage 24*b,* and it is conducted to the inside of the bore 20.

Therefore, an unillustrated compressed fluid supply source is connected to any one of the fluid pressure inlet/outlet ports 200*a* to 200*d,* and thus it is possible to supply the compressed fluid to the compressed fluid passage R. In this case, the fluid pressure inlet/outlet ports 200*a* to 200*d,* which are not used, are closed by plug members. The diameter of the communication passage 202 and the conducting passage 204 is formed to be smaller than the diameter of the fluid pressure inlet/outlet ports 200*a* to 200*d.*

As shown in FIG. 7, the compressed fluid passage L includes fluid pressure inlet/outlet ports 300*a,* 300*b* which are formed on respective side surfaces 100*b,* 102*b* of the head cover 16*b* respectively, a fluid pressure inlet/outlet port 300*c* which is formed on the end surface 104*b* of the head cover 16*b,* a fluid pressure inlet/outlet port 300*d* which is formed on the end surface 104*a* of the head cover 16*a,* and the fluid bypass passage 24*a.*

Only the single fluid pressure inlet/outlet port 300*a,* 300*b* is formed on each of the side surfaces 100*b,* 102*b*. Each of the fluid pressure inlet/outlet ports 300*c,* 300*d,* which is formed on each of the end surfaces 104*b,* 104*a,* is located at a lower portion of the end surface 104*b,* 104*a,* i.e., at a portion in the vicinity of the bottom of the head cover 16*b,* 16*a*. Further, the single fluid pressure inlet/outlet ports 300*a,* 300*b,* which are not overlapped with each other in the height direction, are provided on the respective side surfaces 100*b,* 102*b*. Accordingly, it is possible to suppress the dimension of the head cover 16*a,* 16*b* in the height direction as compared with the head cover 4, 5 concerning the conventional technique shown in FIG. 8. Of course, the positional relationship between the fluid pressure inlet/outlet port 300*a,* 300*b* and the fluid pressure inlet/outlet port 300*c* may be upside down in the head cover 16*b*. That is, the fluid pressure inlet/outlet port 300*a,* 300*b* may be located at a portion in the vicinity of the bottom of the head cover 16*b* as compared with the fluid pressure inlet/outlet port 300*c.*

The fluid pressure inlet/outlet ports 300*a* to 300*c* communicate with the fluid bypass passage 24*a* in the cylinder tube 12 via a communication passage 302 at the inside of the head cover 16*b*. The fluid bypass passage 24*a* communicates with the fluid pressure inlet/outlet port 300*d* at the inside of the head cover 16*a.* A conducting passage 304, which is branched from the communication passage 302, is disposed in parallel to the fluid bypass passage 24*a,* and it is conducted to the inside of the bore 20.

Therefore, the unillustrated compressed fluid supply source is connected to any one of the fluid pressure inlet/outlet ports 300*a* to 300*d,* and thus it is possible to supply the compressed fluid to the compressed fluid passage L. In this case, the fluid pressure inlet/outlet ports 300*a* to 300*d,* which are not used, are closed by plug members. The diameter of the communication passage 302 and the conducting passage 304 is formed to be smaller than the diameter of the fluid pressure inlet/outlet ports 300*a* to 300*d.*

As described above, the compressed fluid passages R, L, which are formed in the rodless cylinder 10 according to the embodiment of the present invention, are formed at the portions in the vicinity of the bottom of the rodless cylinder 10. Therefore, it is possible to suppress the dimension in the height direction of the rodless cylinder 10. It is possible to effect the stable reciprocating action with the low center of gravity. Accordingly, it is possible to realize a small size of the rodless cylinder 10, and it is possible to reduce the installation space.

The compressed fluid passages R, L, which are disposed at the inside of the head covers 16*a,* 16*b,* are formed to be symmetric. In other words, the compressed fluid passages R, L are formed to have the same structure. Accordingly, for example, when the head covers 16*a,* 16*b* are formed by using an unillustrated molding machine, they can be molded with a single mold. That is, the head covers 16*a,* 16*b* can be molded with only one type of the mold. Therefore, it is unnecessary to perform the operation to exchange the jig corresponding to the mold, and it is possible to eliminate complicated operations such as the operation for adjusting the jig. Accordingly, it is possible to remarkably reduce the production cost of the head covers 16*a,* 16*b,* and consequently reduce the production cost of the entire rodless cylinder 10.

The rodless cylinder 10 according to the embodiment of the present invention is basically constructed as described above. Next, its function and effect will be explained.

At first, any one of the fluid pressure inlet/outlet ports 200*a* to 200*d* and any one of the fluid pressure inlet/outlet ports 300*a* to 300*d* are connected to the pressure fluid supply source via an unillustrated solenoid-operated valve. In this case, for example, the fluid pressure inlet/outlet port 200*a* provided for the head cover 16*a* and the fluid pressure inlet/outlet port 300*a* provided for the head cover 16*b* are connected to the solenoid-operated valve, and then the other fluid pressure inlet/outlet ports 200*b* to 200*d* of the head cover 16*a* and the other fluid pressure inlet/outlet ports 300*b* to 300*d* of the head cover 16*b* are closed by plug members 400*a* to 400*f* (see FIG. 1).

As described above, it is enough to use any one of the fluid pressure inlet/outlet ports 200*a* to 200*d* and any one of the fluid pressure inlet/outlet ports 300*a* to 300*d* formed on the side surfaces 100*a,* 102*a,* the end surface 104*a,* the side surfaces 100*b,* 102*b,* and the end surface 104*b* on the other side of the rodless cylinder 10. Therefore, the degree of freedom is improved for the pipe arrangement.

Especially, when a combination of the fluid pressure inlet/outlet ports 200*c,* 300*d* provided for the head cover 16*a* or the fluid pressure inlet/outlet ports 200*d,* 300*c* provided for the head cover 16*b* is selected, the pipe arrangement, which is necessary to perform the reciprocating action of the piston 50, can be constructed by using only one end surface of the end surface 104*a* or the end surface 104*b*. Accordingly, it is possible to construct the pipe arrangement in which the installation space is concentrated.

After that, when the unillustrated solenoid-operated valve is operated to introduce the compressed fluid into the first fluid pressure inlet/outlet port 200*a,* the compressed fluid is conducted into the inside of the bore 20 via the communication passage 202 and the conducting passage 204 to press the pressure-receiving surface 60*a* of the piston 50. The piston 50 is moved rightwardly (in the direction of the arrow X) as shown in FIG. 4 in accordance with the pressing action of the compressed fluid.

In this arrangement, the piston 50 is connected to the slide table 14 via the piston yoke 82. Therefore, the piston 50 is moved, and the slide table 14 is also moved on the upper surface portion of the cylinder tube 12 while being interlocked therewith. Further, the belt separator 84*b* is installed between the upper belt 62 and the lower belt 64. Therefore, the upper belt 62 and the lower belt 64 are separated from each other in the upward and downward directions of the cylinder tube 12 from the slit 22. The upper belt 62 and the lower belt 64, which are separated from each other as described above, are installed to the slit 22 again by the aid of the holding member 86*a*. It will be easily understood that when the compressed fluid is introduced into the other fluid pressure inlet/outlet port 300*a* formed for the head cover 16*b,* the operation is effected in a manner opposite to the above.

What is claimed is:

1. A rodless cylinder provided with a plurality of fluid pressure inlet/outlet ports as introducing ports for a compressed fluid for allowing a piston to perform reciprocating movement, in which said fluid pressure inlet/outlet ports disposed at desired positions are capable of being selected from said plurality of fluid pressure inlet/outlet ports, said rodless cylinder comprising:

a cylinder tube for allowing said piston to perform said reciprocating movement along an internal space by the aid of said compressed fluid;

a fluid bypass passage defined to extend along said internal space of said cylinder tube; and a head cover installed to an end of said cylinder tube for closing said cylinder tube, wherein:

said head cover has, at its inside, a conducting passage for conducting said compressed fluid to said internal space, and said fluid bypass passage is substantially parallel to said conducting passage;

said head cover has a side surface provided with at least one fluid pressure inlet/outlet port, and an end surface provided with at least two fluid pressure inlet/outlet ports respectively; and a total number of said fluid pressure inlet/outlet ports provided for said head cover is at least four or more.

2. The rodless cylinder according to claim 1, wherein said head cover has, at its inside, a communication passage for communicating at least one of said fluid pressure inlet/outlet ports with said fluid bypass passage.

3. The rodless cylinder according to claim 2, wherein said conducting passage is communicated with said communication passage at the inside of said head cover.

4. The rodless cylinder according to claim 2, wherein a diameter of said conducting passage and a diameter of said communication passage are formed to be smaller than a diameter of said fluid pressure inlet/outlet ports.

5. The rodless cylinder according to claim 1, wherein:

said head cover comprises a first head cover installed to a first end of said cylinder tube, and further comprising a second head cover installed to a second end of said cylinder tube; and said first head cover and said second head cover are mutually exchangeable and commonly usable.

6. The rodless cylinder according to claim 5, wherein at least one of said fluid pressure inlet/outlet ports provided on said end surface of said first head cover communicates with a conducting passage formed at the inside of said second head cover.

7. The rodless cylinder according to claim 6, wherein said pressure fluid inlet/outlet port is formed singly on each of said side surfaces of said first head cover.

8. The rodless cylinder according to claim 5, wherein at least one of said fluid pressure inlet/outlet ports provided on said end surface of said second head cover communicates with a conducting passage formed at the inside of said first head cover.

9. The rodless cylinder according to claim 8, wherein said pressure fluid inlet/outlet port is formed singly on each of said side surfaces of said second head cover.

10. The rodless cylinder according to claim 5, wherein said first head cover and said second head cover are identical molded articles.

11. A rodless cylinder provided with a plurality of fluid pressure inlet/outlet ports as introducing ports for a compressed fluid for allowing a piston to perform reciprocating movement, in which said fluid pressure inlet/outlet ports disposed at desired positions are capable of being selected from said plurality of fluid pressure inlet/outlet ports, said rodless cylinder comprising:

a cylinder tube for allowing said piston to perform said reciprocating movement along an internal space by the aid of said compressed fluid;

a fluid bypass passage defined to extend along said internal space of said cylinder tube; and a first head cover installed to a first end of said cylinder tube, and a second head cover installed to a second end of said cylinder tube, for closing said cylinder tube, wherein:

said first and second head covers each comprises a side surface provided with at least one fluid pressure inlet/outlet port, and an end surface provided with at least two fluid pressure inlet/outlet ports respectively;

a total number of said fluid pressure inlet/outlet ports provided for each of said first and second head covers is at least four or more; and said first and second head covers are mutually exchangeable and commonly usable.

12. The rodless cylinder according to claim 11, wherein each of said head covers has, at its inside, a conducting passage for conducting said compressed fluid to said internal space, and a communication passage for communicating at least one of said fluid pressure inlet/outlet ports with said fluid bypass passage.

13. The rodless cylinder according to claim 12, wherein said conducting passage of each of said head covers is communicated with said communication passage at the inside of each of said head covers.

14. The rodless cylinder according to claim 12, wherein said fluid bypass passage is substantially parallel to said conducting passage of each of said head covers.

15. The rodless cylinder according to claim 12, wherein a diameter of said conducting passage and a diameter of said communication passage, in each of said head covers, are formed to be smaller than a diameter of said fluid pressure inlet/outlet ports.

16. The rodless cylinder according to claim 11, wherein at least one of said fluid pressure inlet/outlet ports provided on said end surface of said first head cover communicates with a conducting passage formed at the inside of said second head cover.

17. The rodless cylinder according to claim 16, wherein said pressure fluid inlet/outlet port is formed singly on each of said side surfaces of said first head cover.

18. The rodless cylinder according to claim 11, wherein at least one of said fluid pressure inlet/outlet ports provided on said end surface of said second head cover communicates with a conducting passage formed at the inside of said first head cover.

19. The rodless cylinder according to claim 18, wherein said pressure fluid inlet/outlet port is formed singly on each of said side surfaces of said second head cover.

20. The rodless cylinder according to claim 11, wherein said first head cover and said second head cover are identical molded articles.

* * * * *